US005452755A

United States Patent [19]

Morikawa et al.

[11] Patent Number: 5,452,755

[45] Date of Patent: Sep. 26, 1995

[54] CASTING APPARATUS FOR LOW-MELTING METALS HAVING TWO OR MORE COATING LAYERS

[75] Inventors: Katsumi Morikawa; Jyouki Yoshitomi, both of Fukuoka, Japan

[73] Assignee: Krosaki Corporation, Fukuoka, Japan

[21] Appl. No.: 226,234

[22] Filed: Apr. 11, 1994

Related U.S. Application Data

[63] Continuation of Ser. No. 955,556, Oct. 1, 1992, abandoned.

[30] Foreign Application Priority Data

Oct. 9, 1991 [JP] Japan ..... 3-262358

[51] Int. Cl.[6] ..... B22C 1/00; B22D 11/04

[52] U.S. Cl. ..... 164/418; 164/138

[58] Field of Search ..... 164/138, 418; 266/280, 286

[56] References Cited

U.S. PATENT DOCUMENTS

| | | | |
|---|---|---|---|
| 4,174,972 | 11/1979 | Dreuzy et al. | 106/64 |
| 4,911,225 | 3/1990 | Leppänen | 164/418 |
| 4,998,710 | 3/1991 | Pelton | 266/280 |
| 5,033,721 | 7/1991 | Gnyra | 266/280 |

FOREIGN PATENT DOCUMENTS

| | | | |
|---|---|---|---|
| 1558177 | 9/1972 | Germany | 164/418 |
| 56-6772 | 1/1981 | Japan . | |
| 56-68555 | 6/1981 | Japan | 164/418 |
| 161162 | 7/1991 | Japan . | |
| 130675 | 1/1960 | U.S.S.R. | 266/280 |
| 1417992 | 8/1988 | U.S.S.R. | 266/280 |
| 2027375 | 2/1980 | United Kingdom | 164/418 |

*Primary Examiner*—Mark Rosenbaum
*Assistant Examiner*—I. H. Lin
*Attorney, Agent, or Firm*—Jordan and Hamburg

[57] ABSTRACT

A casting apparatus for low-melting metals has a coating layer of two-layered structure which hardly reacts with low-melting metals, adheres firmly to the substrate, and protects the substrate from thermal and mechanical shocks for a long period of time. The layer in contact with the substrate contains glass powder having a melting point below 1000° C. and at least one binder selected from silicates and phosphates. The layer in contact with molten metal contains 5–80 wt. % of at least one fluorine compound (as a corrosion resistant material) having a melting point of above 700° C. Owing to the multiple layers, each having a specialized function, the casting apparatus has improved durability over a long period of time.

26 Claims, 4 Drawing Sheets

CASTING APPARATUS FOR LOW-MELTING METALS HAVING TWO OR MORE COATING LAYERS

This application is a continuation of application Ser. No. 07/955,556 filed Oct. 1, 1992, now abandoned.

BACKGROUND OF THE INVENTION

1. Field of the Invention

The present invention relates to a casting apparatus having two or more coating layers, which is suitable for the casting of low-melting metals including aluminum, zinc, tin, and alloys thereof.

2. Description of the Prior Art

The casting of low-melting metals requires such apparatus as a stalk, ladle, protecting tube for the thermocouple, molten metal stirring blade, and a gas blowing tube. It is conventional practice to make these items from metal such as ferrous alloy, refractory, or ceramics.

Those apparatus which are used for the casting of aluminum alloys are usually made of, for example, cast iron, which offers high strength, low price, and good formability. Cast iron, however, has the disadvantage of being susceptible to corrosion from molten aluminum. Upon corrosion, the cast iron dissolves into the molten aluminum, which leads to contamination and deterioration of the cast aluminum.

In order to solve this problem, the use of ceramic apparatus or the coating of cast iron apparatus has been proposed.

For example, Japanese Patent Laid-open Application (KOKAI-KOHO) No. 180657/1985 discloses a ceramic stalk for low-pressure casting which is made from metallic silicon, alone or together with refractory aggregates, by nitriding sintering. The ceramic stalk prevents contamination. This merit, however, is offset by the fact that it is ten times more expensive than a cast iron stalk and that it is easily broken under load and hence has a rather short life for its high price. In addition, it is difficult to make casting apparatus of complex shapes from ceramics.

Also, Japanese Patent Laid-open No. 6772/1981 discloses the formation of a corrosion-resistant boron nitride coating on casting apparatus in contact with molten aluminum or aluminum alloy. Although boron nitride itself provides good corrosion resistance, the boron nitride coating does not provide sufficient durability because of its poor adhesion to the substrate.

A common practice to impart durability is the use of a binder. A binder for a coating on a ferrous substrate should meet the following requirements.

It does not rust the substrate during fabrication.

It should have a coefficient of thermal expansion close to that of a ferrous base metal.

It should have good adhesion to the substrate.

It should have good resistance to oxidation.

Common materials meeting these requirements are silicates and a variety of glass powders, including borosilicate glass, having a melting point below 1000° C.

There was proposed in Japanese Patent Application No. 300250/1989 [Japanese Patent Laid-open Application (KOKAI-KOHO) No. 161162/1991] a corrosion-resistant coating material containing a fluorine compound having a melting point higher than 700° C. According to the disclosure, this coating material is used to form a single coating layer on casting apparatus for low-melting metals. However, the use of a binder is restricted by the substrate to which it is applied. Moreover, it is inconceivable that corrosion resistance varies depending on the kind of a binder.

In other words, a fluorine compound present in a single coating layer containing either an alkaline component such as silicate or a low-melting component such as borosilicate glass will undergo reduction and degrade the coating material. Therefore, the binder will not contribute to the long-term durability of the coating layer.

It is known that a coating layer does not react with low-melting metals if it contains a fluorine compound and employs a highly heat resistant binder in the form of sol such as silica sol and alumina sol. Such a coating layer, however, offers little long-term durability because its adhesion to the substrate resorts to mechanical bonding and hence, it is subject to peeling from thermal and mechanical shocks.

SUMMARY OF THE INVENTION

It is an object of the present invention to provide a casting apparatus for low-melting metals which has a corrosion-resistant coating layer which hardly reacts with low-melting metals, adheres firmly to the substrate, and protects the substrate from thermal and mechanical shocks for a long period of time.

DETAILED DESCRIPTION OF THE INVENTION

Figure 1:
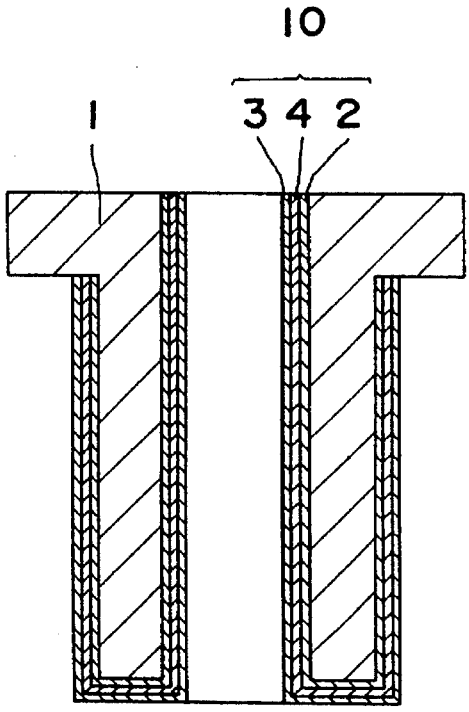
FIG. 1 is a sectional view showing a stalk to which the present invention is applied.

The present invention was completed on the basis of a finding that a single corrosion-resistant coating layer containing a fluorine compound is not enough to extend the life of casting apparatus for low-melting metals which depends on adhesion to the substrate, corrosion resistance, and resistance to thermal and mechanical shocks. The present invention is embodied in a casting apparatus for low-melting metals which has two or more coating layers, with the one in contact with the substrate being an adhesive coating layer containing an adhesive binder, and the one in contact with molten metal being a corrosion-resistant coating layer containing a corrosion-resistant material.

A preferred binder for the adhesive coating layer to be made on a substrate of ferrous material (such as cast iron) includes silicates (such as sodium silicate and potassium silicate) and glass powders (such as borosilicate glass) having a melting point below 1000° C. These binders may be used in combination with one another. A preferred binder for the adhesive coating layer to be made on a substrate of ceramics or refractory material includes phosphoric acid, phosphates (such as aluminum phosphate), zirconium salt, and alumina cement, in addition to the above-mentioned binders.

The binder may optionally be incorporated with one or more fluorine compounds (such as aluminum fluoride, calcium fluoride, and magnesium fluoride) having a melting point of above 700° C. to impart corrosion resistance.

The adhesive coating layer contains refractory aggregates which include a variety of refractory oxides (such as aluminum oxide, titanium oxide, magnesium oxide, silicon oxide, zirconium oxide, chamotte, and mullite), a variety of non-oxide powders (such as silicon carbide, boron carbide, silicon nitride, boron nitride, and aluminum nitride), and metal powders which are commonly used as coating materials. The corrosion-resistant coating layer, which is in contact with molten metal, should contain one or more fluorine compounds (such as aluminum fluoride, calcium fluoride, and magnesium fluoride) having a melting point of above 700° C., in an amount of 5–80 wt. %, which impart corrosion resistance.

Examples of the binder include alumina sol, silica sol, phosphates, silane compounds, metal alkoxides, and metal acylates, which are highly heat resistant. The corrosion-resistant aggregate is selected from non-oxide powders (such as silicon carbide, boron carbide, silicon nitride, boron nitride, and aluminum nitride) and talc. It may also be selected from the above-mentioned refractory oxides to be used as the aggregate of the adhesive coating layer.

Incidentally, the binder and aggregate for the adhesive coating layer should be selected from those materials which have a coefficient of thermal expansion very close to that of the substrate.

Each layer may be formed by dipping, brushing, or spraying so that the resulting layer has a thickness of 50–200 μm.

According to the present invention, the multi-layered coating improves the long-term durability of the substrate due to the specialized function of each layer.

The fact that the adhesive coating layer in contact with the substrate has a coefficient of thermal expansion very close to that of the substrate itself contributes to firm adhesion between the coating layer and the substrate and hence prevents the coating layer from peeling from the substrate. The adhesive coating layer formed on a ferrous substrate is especially resistant to peeling if it contains a binder selected from silicates (which are soft at low temperatures and have a comparatively high coefficient of thermal expansion) and/or a glass powder (such as borosilicate glass) having a melting point below 1000° C., because not only does it exhibit good adhesion to the substrate but it also softens at high temperatures to absorb strain. In the case of ceramic or refractory substrates, the above-mentioned binder as well as the phosphate binder produce good bonding effects, making the adhesive coating layer highly resistant to peeling.

On the other hand, the coating layer in contact with molten metal contains a fluorine compound in an amount of 5–80 wt. %, so that its surface is covered with a compact protective film which prevents the coating layer from reacting with molten metal and hence prevents the coating layer from becoming brittle.

With less than 5 wt. %, the fluorine compound (as a corrosion-resistant material) does not exhibit the desired corrosion resistance. Conversely, with an amount in excess of 80 wt. %, the fluorine compound tends to cause peeling because of an excess coefficient of thermal expansion.

If there is a big difference in the coefficient of thermal expansion between the adhesive coating layer and the corrosion resistant coating layer, it is better to interpose one or more intermediate coating layers between them, which release the thermal stress due to the difference in thermal expansion and thus prevent one layer from peeling from the other.

EXAMPLES

To further illustrate the invention, not by way of limitation, the following examples are given.

Figure 2:
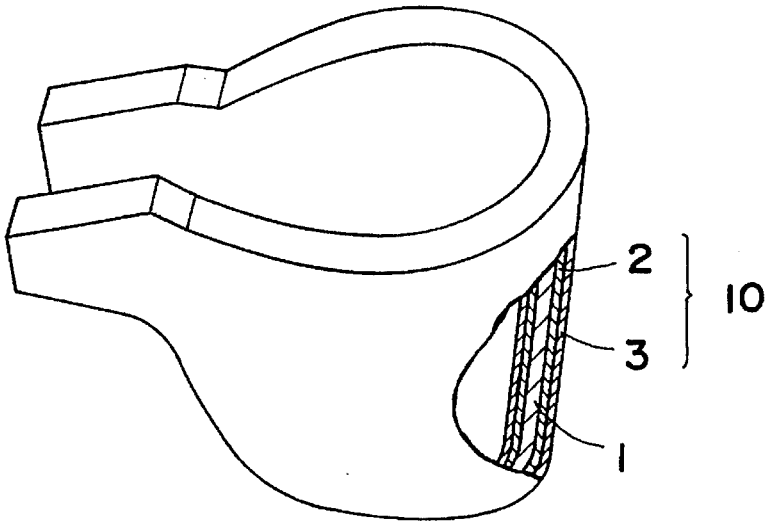
FIG. 2 is a partly cutaway perspective view showing a ladle to which the present invention is applied.
Figure 3:
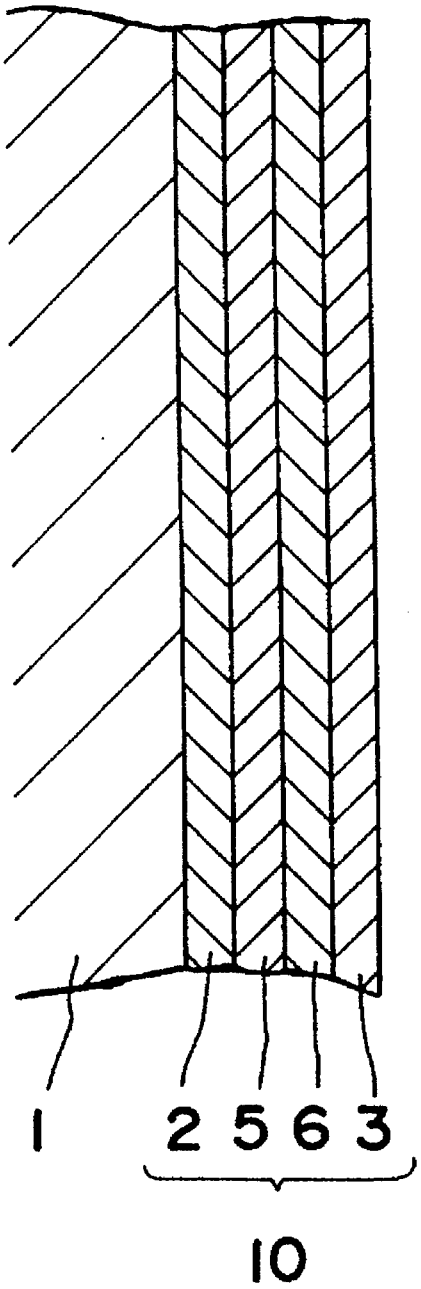
FIG. 3 is a schematic section view showing the coating layers of a multi-layered structure.

FIGS. 1 to 3 show some examples of the casting apparatus for low-melting metals to which the present invention can be applied.

FIG. 1 is a sectional view showing a stalk for casting which has a triple coating layer 10 formed on the surface thereof.

In FIG. 1, there is shown a substrate 1, which is the stalk proper. The coating layer 10 is composed of an adhesive coating layer 2 and a corrosion resistant coating layer 3, with an intermediate 4 layer interposed between them. The intermediate layer 4 adjusts the difference in the coefficient of thermal expansion between the two layers 2 and 3.

FIG. 2 is a partly cutaway perspective view showing a ladle which has a double coating layer 10 composed of an adhesive coating layer 2 (formed on the entire surface of the substrate 1) and a corrosion resistant layer 3 (which comes into contact with molten metal).

FIG. 3 is a schematic sectional view showing the structure of a quadruple coating layer 10 which is composed of an adhesive coating layer 2 and a corrosion resistant coating layer 3, with intermediate layers 5 and 6 interposed between them. The intermediate layer 5 has a coefficient of thermal expansion close to that of the adhesive coating layer 2, and the intermediate layer 6 has a coefficient of thermal expansion close to that of the corrosion resistant coating layer 3.

The characteristic properties of the coating layer 10 were tested in the following manner.

TEST EXAMPLE 1

A rod having the diameter of 20 mm and the length of 100 mm was prepared as a test piece from a substrate conforming to JIS FC20 which is commonly used for casting apparatus.

The rod was provided with an adhesive coating layer 2 and a corrosion resistant coating layer 3. The former was formed from a slurry containing aggregates with a chemical composition shown in Table 1. The latter was formed from a slurry containing aggregates with a chemical composition shown in Table 2. Incidentally, the aggregates for the adhesive coating layer contain borosilicate glass powder.

TABLE 1

| | wt % |
|---|---|
| $Al_2O_3$ | 20 |
| $SiO_2$ | 56 |
| MgO | 5 |
| $Cr_2O_3$ | 4 |
| $Na_2O$ | 4 |
| $B_2O_3$ | 9 |
| CoO | 2 |

TABLE 2

| | wt % |
|---|---|
| SiC | 55 |
| BN | 45 |

Table 3 shows the formulations of the adhesive coating layer 2 and corrosion resistant coating layer 3, the former containing aggregates with a chemical composition shown in Table 1 and the latter containing aggregates with a chemical composition shown in Table 2. The adhesive coating layer 2 employed sodium silicate as a binder, and the corrosion resistant coating layer 3 employed silica sol as a binder. Although these binders contain water, the amounts are expressed in terms for solids because water is lost during heat treatment. The amount of water added for viscosity adjustment is indicated as an addition. Incidentally, the fluorine compound is calcium fluoride.

TABLE 3

| | Comparative Example No. | | | Example No. | | | | | Comparative Example No. | | |
|---|---|---|---|---|---|---|---|---|---|---|---|
| | 1 | 2 | 3 | 1 | 2 | 3 | 4 | 5 | 4 | 5 | 6 |
| Adhesive coating layer Formulation (wt %) | | | | | | | | | | | |
| Aggregate | 80 | 70 | — | 80 | 80 | 70 | 80 | 80 | 80 | 80 | 80 |
| Fluorine compound | 0 | 10 | — | 0 | 0 | 10 | 0 | 0 | 0 | 0 | 0 |
| Sodium silicate binder (solids) | 20 | 20 | — | 20 | 20 | 20 | 20 | 20 | 20 | 20 | 20 |
| Water | +40 | +40 | — | +40 | +40 | +40 | +40 | +40 | +40 | +40 | +40 |
| Coefficient of thermal expansion ($\times 10^{-6}$/°C.) | 14.0 | 14.0 | | 14.0 | 14.0 | 14.5 | 14.0 | 14.0 | 14.0 | 14.0 | 14.0 |
| Corrosion resistant coating layer Formulation (wt %) | | | | | | | | | | | |
| Aggregate | — | — | 75 | 80 | 40 | 40 | 20 | 5 | 85 | 83 | 0 |
| Fluorine compound | — | — | 10 | 5 | 45 | 45 | 65 | 80 | 0 | 2 | 85 |
| Silica sol binder (solids) | — | — | 15 | 15 | 15 | 15 | 15 | 15 | 15 | 15 | 15 |
| Water | — | — | +65 | +65 | +65 | +65 | +65 | +65 | +65 | +65 | +65 |
| Coefficient of thermal expansion ($\times 10^{-6}$/°C.) | | | 12.2 | 12.0 | 13.1 | 13.1 | 14.5 | 16.0 | 11.9 | 11.8 | 16.5 |
| Thickness of adhesive coating layer (μm) | ca. 200 | ca. 200 | 0 | ca. 100 | ca. 100 | ca. 100 | ca. 100 | ca. 100 | ca. 100 | ca. 100 | ca. 100 |
| Thickness of corrosion resistant coating layer (μm) | 0 | 0 | ca. 200 | ca. 100 | ca. 100 | ca. 100 | ca. 100 | ca. 100 | ca. 100 | ca. 100 | ca. 100 |
| Adhesion of aluminum after immersion for | | | | | | | | | | | |
| 1 week | much | none | none | none | none | none | none | none | much | none | none |
| 4 week | much | little | none | none | none | none | none | none | much | little | none |
| 8 week | | much | none | none | none | none | none | none | much | some | none |
| 12 week | | | none | none | none | none | none | none | | much | none |
| After the spalling test*[1] | intact | intact | intact | intact | intact | intact | intact | intact | intact | intact | partly peeled |
| Damage to the substrate (mm)[2] after | | | | | | | | | | | |
| 1 week | 3 | 0 | 0 | 0 | 0 | 0 | 0 | 0 | 3 | 0 | 0 |
| 4 week | 18 | 0 | 0 | 0 | 0 | 0 | 0 | 0 | 18 | 0 | 0 |
| 8 week | — | 15 | 0 | 0 | 0 | 0 | 0 | 0 | — | 2 | 0 |
| 12 week | — | — | 0 | 0 | 0 | 0 | 0 | 0 | — | 10 | 0 |

Note to Table 3
*[1] Test conditions: (750° C. × 5 min → air cooling × 10 min) × 20 cycles
*[2] Damage to substrate (mm) = Diameter of substrate (20 mm) before testing - Diameter of substrate after testing (mm)

The adhesive coating layer and corrosion resistant coating layer shown in Table 3 were formed on the substrate by brushing so that each layer was 100–200 μm thick. After brushing, the coating layers were aged at room temperature and then heated. Some samples were prepared by brushing on the adhesive coating layer first and subsequently heating the layer, and then brushing the corrosion resistant coating layer on the adhesive coating layer and subsequently heating that.

The samples were tested after preheating by gradually immersing them in molten aluminum at 750° C. held in an alumina crucible heated in an electric furnace. After immersion for 1 week, 4 weeks, 8 weeks, and 12 weeks, the samples were removed from the molten aluminum and examined for damage and adhesion of aluminum. The samples were also tested for resistance to thermal shocks. The casting metal is an aluminum alloy conforming to JIS ADC12. The test results are shown in the lower rows of Table 3.

Incidentally, the substrate has a coefficient of linear expansion of $14.0\times10^{-6}$/°C. in the range from room temperature to 700° C.

Examples 1 to 5 show that the coating layer of double-layer structure composed of the adhesive coating layer and the corrosion resistant coating layer (containing 5–80 wt. % fluorine compound) formed thereon remains intact for 12 weeks after immersion, with no damage to the substrate. It is also superior in spalling resistance. Presumably, this is because the adhesive coating layer functions as an adhesive to bond the corrosion resistant coating layer to the substrate while simultaneously relieving the stress which occurs between the two coating layers. In addition, Example 3 shows that the fluorine compound in the adhesive coating layer produces no adverse effect at all.

By contrast, Comparative Example 1 (in which the adhesive coating layer contains no fluorine compound) shows that the corrosion of the substrate begins after 1 week of immersion and proceeds to such an extent that the substrate disappears almost completely after 4 weeks of immersion. Comparative Example 2 (in which the adhesive coating layer contains 10 wt. % fluorine compound) shows that the substrate remains resistant to molten aluminum for 4 weeks of immersion but disappears almost completely after 8 weeks of immersion. These results indicate that the adhesive coating layer containing sodium silicate (containing low-melting components) as a binder does not last for more than 1 month when it is used alone, even though it contains a fluorine compound. Comparative Example 3 (in which the corrosion resistant coating layer contains as much fluorine compound as in the adhesive coating layer in Comparative Example 2) shows that the substrate remains intact even after 12 weeks even though the corrosion resistance coating layer is used alone. This is attributable to the heat-resistant silica sol binder containing no low-melting components. The sample in Comparative Example 3, however, shows poor spalling resistance due to poor adhesion of the coating layer to the substrate and the difference in the coefficient of thermal expansion between the coating layer and the substrate.

Comparative Examples 4 to 6 show that even the coating layer of a double-layer structure poses a problem with durability if the content of fluorine compound in the corrosion resistant coating layer is less than 5 wt. % or more than 80 wt. %. With an amount of fluorine compound of less than 5 wt. %, the corrosion resistant coating layer is poor in corrosion resistance. With an amount of fluorine compound of more than 80 wt. %, the corrosion resistant coating layer is poor in spalling resistance due to the difference in thermal expansion between the coating layer and the substrate.

The coating layer of Example 3 was tested using an actual stalk for low-pressure casting of aluminum alloys. The stalk is made of a metal conforming to JIS FC20. The stalk with the coating layer lasted for 2.5 months without repair, whereas an ordinary stalk usually needs repair every week. In other words, the coating layer extends the life of a stalk by ten times. The test in which the coating layer pertaining to the present invention was applied to a ceramic stalk, fiber ladle, and pot crucible for melting aluminum alloys showed that it is possible to greatly reduce the amount of aluminum sticking to the casting apparatus and to greatly improve the life of the casting apparatus.

The foregoing description was made with reference to a molten aluminum alloy as a low-melting alloy. It was confirmed that the same good results as above are also obtained in the case of zinc alloys and tin alloys.

TEST EXAMPLE 2

The effect of an intermediate layer interposed between the adhesive coating layer and the corrosion resistant coating layer was tested. As in Test Example 1, each coating layer was made from a slurry containing an aggregate, binder, and fluorine compound in different amounts. The chemical composition of the aggregates in the adhesive coating layer is shown Table 4. The chemical composition of the aggregates in the intermediate coating layer is shown in Table 5. Incidentally, the aggregates contain borosilicate glass powder. The aggregates in the corrosion resistant coating layer have the same chemical composition as shown in Table 2.

TABLE 4

| | wt. % |
|---|---|
| $Al_2O_3$ | 20 |
| $SiO_2$ | 30 |
| MgO | 27 |
| $Na_2O$ | 12 |
| $B_2O_3$ | 9 |
| CoO | 2 |

TABLE 5

| | wt. % |
|---|---|
| $Al_2O_3$ | 23 |
| $SiO_2$ | 40 |
| MgO | 20 |
| $Na_2O$ | 8 |
| $B_2O_3$ | 9 |

The adhesive coating layer and intermediate coating layer each contain sodium silicate as a binder, while the corrosion resistant coating layer contains silica sol as a binder. The fluorine compound is calcium fluoride. Although these binders contain water, their amounts are expressed in terms for solids because water is lost during heat treatment. The amount of water added for viscosity adjustment is indicated as an addition. Table 6 shows the formulation of each coating layer and the coefficient of linear expansion of the coating layer which has undergone heat treatment.

TABLE 6

| | wt. % Adhesive coating layer | wt. % Intermediate coating layer | wt. % Corrosion resistant coating layer |
|---|---|---|---|
| Aggregate | 80 | 75 | 20 |
| Fluorine compound | 0 | 5 | 65 |
| Binder (as solids) | 20 | 20 | 15 |
| Water | +40 | +40 | +85 |
| Coefficient of linear expansion ($\times 10^{-6}$/°C.)* | 17.5 | 16.3 | 14.5 |

*An average value in the range of room temperature to 700° C.

A test piece was prepared from sheet metal (SUS 304) measuring 60×120×1 mm. Incidentally, the coefficient of thermal expansion of SUS 304 is $18.7\times10^{-6}$/°C.

The adhesive coating layer was brushed on the substrate so that a desired thickness was obtained. After brushing, the adhesive coating layer was aged at room temperature and then heated. The intermediate layer and corrosion resistant layer were brushed on the adhesive coating layer and subsequently heated so that a desired thickness was obtained. (The sample in Comparative Example 7 lacks the intermediate coating layer, and the sample in Comparative Example 8 lacks the adhesive coating layer.) The total thickness of the coating layers is 200 μm.

For the evaluation of spalling resistance, the samples were tested after preheating by gradually immersing them in molten aluminum at 750° C. heated in an electric furnace. The molten metal is an aluminum alloy conforming to JIS ADC12. The test results are shown in Table 7.

TABLE 7

| | Comparative Example No. 7 | Example No. 6 | 7 | 8 | Comparative Example No. 8 |
|---|---|---|---|---|---|
| Thickness of adhesive coating layer (μm) | ca. 100 | ca. 75 | ca. 50 | ca. 25 | 0 |
| Thickness of intermediate coating layer (μm) | 0 | ca. 25 | ca. 50 | ca. 75 | ca. 100 |
| Thickness of corrosion resistant coating (μm) | ca. 100 | ca. 100 | ca. 100 | ca. 100 | ca. 100 |
| State after heating | intact | intact | intact | intact | peeled |
| Dipping spalling test | | | | | |
| 1st time | partly peeled | no peeling | no peeling | no peeling | (suspended) |
| 2nd time | partly peeled | no peeling | no peeling | no peeling | |
| 3rd time | partly peeled | no peeling | no peeling | no peeling | |
| 4th time | all peeled | no peeling | no peeling | no peeling | |
| 5th time | all peeled | no peeling | no peeling | no peeling | |
| 10th time | (suspended) | no peeling | no peeling | no peeling | |
| 15th time | | no peeling | no peeling | no peeling | |
| 20th time | | no peeling | no peeling | no peeling | |

Dipping spalling test: (750° C. × 10 min. dipping → cooling at room temperature × 20 min.) × 20 cycles Examples 6 to 8 are designed to demonstrate the effect of the intermediate coating layer interposed between the adhesive coating layer and the corrosion resistant coating layer. The intermediate layer has a coefficient of thermal expansion which is intermediately between those of the two layers. It is to be noted that the spalling resistance is greatly improved by the intermediate layer which relieves thermal stress.

By contrast, Comparative Example 7 showed poor results in which the intermediate layer is absent and the adhesive coating layer and the corrosion resistant coating layer, which greatly differ from each other in the coefficient of thermal expansion, are formed directly adjacent to each other. The coating layers remained intact after heat treatment but failed in the dipping spalling test, that is, they partly peeled in the first test and they almost completely peeled in the fourth test. Comparative Example 8 also showed poor results in which the adhesive coating layer is absent and the intermediate layer has a coefficient of thermal expansion which greatly differs from that of the substrate. The coating layers entirely peeled in the cooling cycle that followed the heating cycle due to the difference in the coefficient of thermal expansion, and hence the dipping spalling test was suspended.

Figure 4:
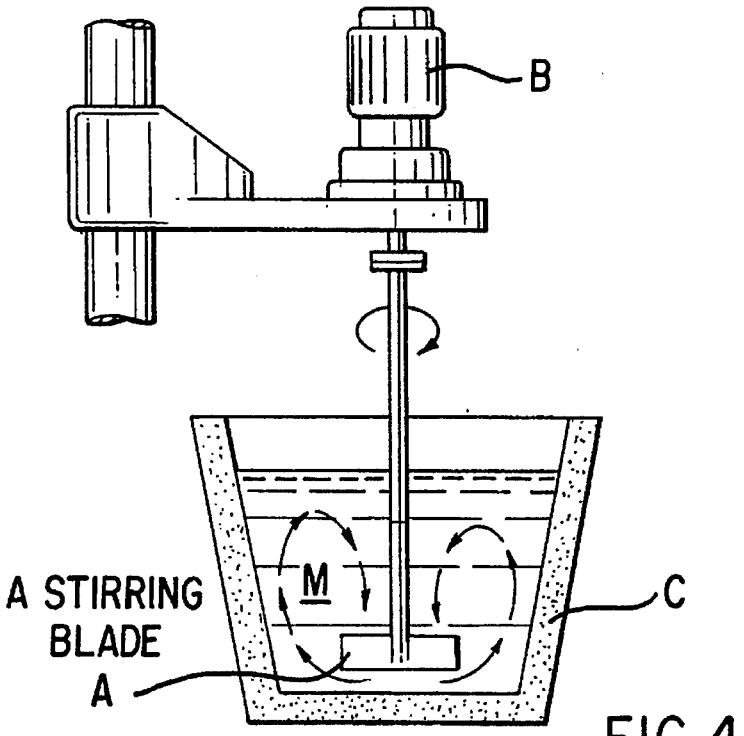
FIG. 4 is a schematic view of a stirring blade.
Figure 5:
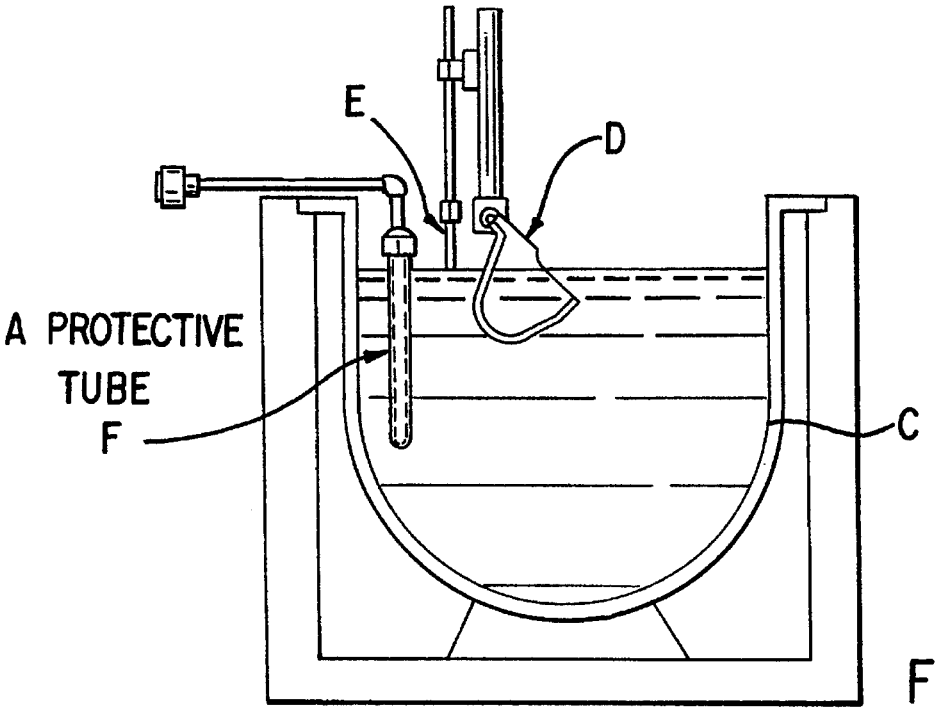
FIG. 5 is a schematic view of a protective tube.
Figure 6:
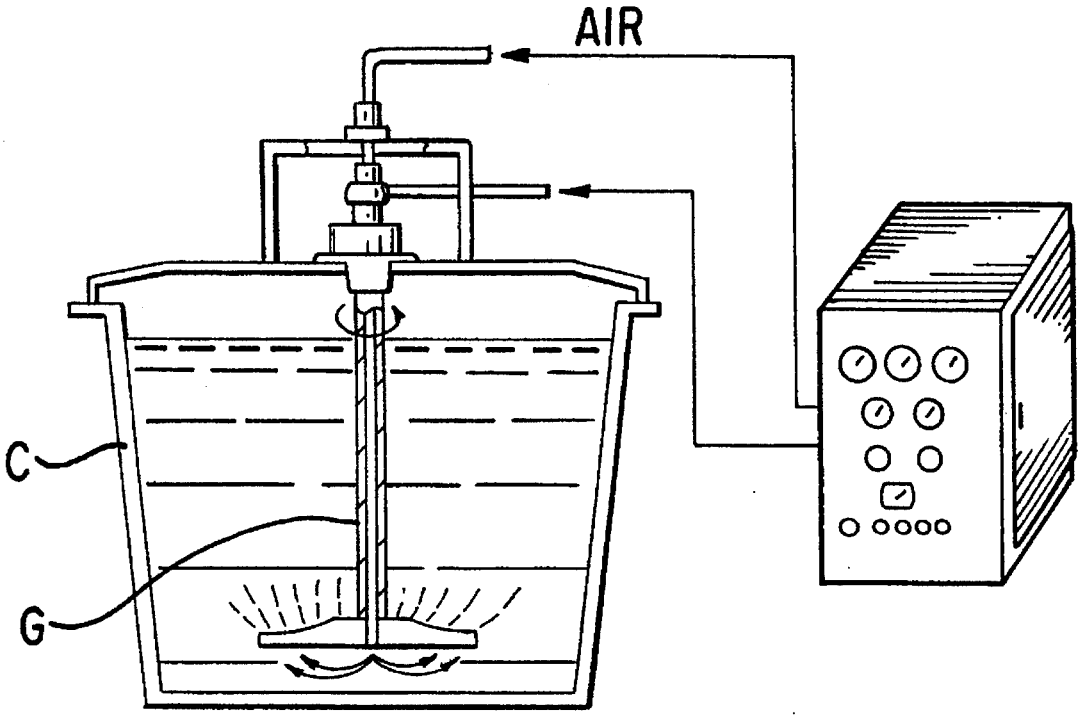
FIG. 6 is a schematic view of a gas blowing tube.

FIG. 4 is a schematic view of a stirring blade A rotated by a motor B in a molten metal M in a container C. FIG. 5 is a schematic view of a protective tube showing a ladle D, a detector E for detecting the level of the molten metal M contained in the container C and a protective tube F for a thermometer. FIG. 6 is a schematic view showing an example of a gas blowing tube G blowing air and an inert gas such as Ar or $N_2$.

The present invention has the following advantages.

(1) It offers casting apparatus for low-melting metals, said apparatus being durable due to the adhesive coating layer and protective coating layer formed thereon which prevent the substrate from reacting with molten metal and protect the substrate from thermal and mechanical shocks.

(2) The protective coating layer prevents the underlying adhesive coating layer from becoming brittle, and produces a secondary effect of preventing the sticking of molten metal.

(3) The casting apparatus of improved durability dispenses with the need of frequent repairs over a long period of time.

What is claimed is:

1. A structure used in casting low-melting metals selected from the group consisting of aluminum, zinc and tin and their alloys, said structure comprising:

a substrate;

an adhesive coating layer applied by coating means selected from the group of dipping, brushing and spraying, said adhesive coating layer being in contact with said substrate, said adhesive coating layer being formed by an adhesive coating material having a melting point below 1000° C., said adhesive coating material including a first binder and a first aggregate, said first binder being selected from the group consisting of silicates, glass powder, phosphoric acid, phosphates, zirconium salt and aluminum cement, said first aggregate being selected from the group consisting of refractory oxides, non-oxide powders and metal powders, said adhesive coating layer having a thickness in the range of approximately 50 μm to 200 μm; and a corrosion-resistant outermost coating layer applied by coating means selected from the group of dipping, brushing and spraying, said corrosion-resistant outermost coating layer contacting the molten metal carried by said casting structure, said corrosion-resistant outermost coating layer being formed by a corrosion-resistant coating material containing approximately 5–80 wt. % of at least one fluorine compound having a melting point greater than 700° C. and the remainder of said corrosive-resistant outermost coating material including a second binder and a second aggregate, said second binder being selected from the group consisting of aluminum sol, silica sol, phosphates, silane compounds, metal alkoxides and metal acylates, said second aggregate being selected from the group consisting of non-oxide powders, refractory oxides and talc, said corrosion-resistant outermost coating layer having a thickness in the range of approximately 50 μm to 200 μm.

2. A structure according to claim 1 wherein said silicates in said first binder is selected from the group consisting of sodium silicate and potassium silicate.

3. A structure according to claim 1 wherein said glass powder in said first binder is borosilicate glass.

4. A structure according to claim 1 wherein said phosphates in said first binder include aluminum phosphate.

5. A structure according to claim 1 wherein said refractory oxides in said first aggregate is selected from the group consisting of aluminum oxide, titanium oxide, magnesium oxide, silicon oxide, zirconium oxide, chamotte and mullite.

6. A structure according to claim 1 wherein said non-oxide powders in said first aggregate are selected from the group consisting of silicon carbide, boron carbide, silicon nitride, boron nitride, and aluminum nitride.

7. A structure according to claim 1, wherein said non-oxide powders in said second aggregate are selected from the group consisting of silicon carbide, boron carbide, silicon nitride, boron nitride, and aluminum nitride.

8. A structure according to claim 1, wherein said refractory oxides in said second aggregate are selected from the group consisting of aluminum oxide, titanium oxide, magnesium oxide, silicon oxide, zirconium oxide, chamotte and mullite.

9. A structure according to claim 1, wherein said first binder includes a fluorine compound having a melting point of about 700° C.

10. A structure according to claim 1, wherein said substrate is made of a ferrous material and said first binder is selected from silicates and glass powder.

11. A structure according to claim 1, wherein said silicates are selected from the group consisting of sodium silicates and potassium silicate and said glass power is borosilicate glass.

12. A structure according to claim 1, wherein said substrate is made of a ceramic or a refractory material, said first binder being selected from the group consisting of phosphoric acid, phosphates, zirconium salt, and aluminum cement.

13. A structure according to claim 12, wherein said phosphates include aluminum phosphate.

14. A structure according to claim 1, wherein said fluorine compound is calcium fluoride.

15. A structure according to claim 1 wherein said corrosion-resistant coating material contains greater than 10 wt. % of said at least one fluorine compound.

16. A structure according to claim 1 wherein said adhesive coating layer is in contact with said corrosion-resistant outermost coating layer.

17. A structure according to claim 1 further comprising one or more intermediate layer between said adhesive coating layer and said corrosion-resistant outermost coating layer.

18. A structure according to claim 1, wherein said substrate has a first coefficient of thermal expansion, said adhesive coating layer having a second coefficient of thermal expansion, said corrosion-resistant outermost coating layer having a third coefficient of thermal expansion, said second coefficient of thermal expansion being intermediate said first and third coefficients of thermal expansion of said corrosive-resistant outermost layer.

19. A structure used in casting low-melting metals selected from the group consisting of aluminum, zinc and tin and their alloys, said structure comprising:

a substrate;

an adhesive coating layer in contact with the substrate and formed by an adhesive coating material having a melting point below 1000° C., said adhesive coating material including a first binder and a first aggregate, said first binder being selected from the group consisting of silicates, glass powder, phosphoric acid, phosphates, zirconium salt and aluminum cement, said first aggregate being selected from the group consisting of refractory oxides, non-oxide powders and metals powders, said adhesive coating layer having a thickness in the range of approximately 50 μm to 200 μm;

a corrosion-resistant outermost coating layer for contact with the molten metal carried by said structure, said corrosion-resistant outermost layer being formed by a corrosion-resistant coating material containing approximately 5–80 wt. % of at least one fluorine compound having a melting point greater than 700° C. and the remainder of said corrosion-resistant outermost coating material including a second binder and a second aggregate, said second binder being selected from the group consisting of aluminum sol, silica sol, phosphates, silane compounds, metal alkoxides and metal acylates, said second aggregate being selected from the group consisting of non-oxide powders, refractory oxides and talc, said corrosion-resistant outermost coating layer having a thickness in the range of approximately 50 μm to 200 μm; and an intermediate layer between said adhesive coating layer and said corrosion-resistant outermost coating layer, said substrate, said adhesive coating layer, said intermediate layer, and said corrosion-resistant outermost coating layer having first to fourth coefficients of thermal expansion respectively, said second coefficient being less than said first coefficient said third coefficient being less than said second coefficient, and said fourth coefficient being less than said third coefficient.

20. A structure according to claim 19, wherein said intermediate layer includes a third binder, a third aggregate and a fluorine compound, the weight percent of said third aggregate being different than the weight percent of said first and second aggregates.

21. A structure according to claim 20, wherein the weight percent of said third binder is different than the weight percent of said second binder.

22. A structure according to claim 19, wherein the weight percent of said third aggregate is less than the weight percent of said first aggregate and greater than the weight percent of said second aggregate.

23. A structure according to claim 19, wherein the weight percent of said third binder is greater than the weight percent of said second binder.

24. A structure according to claim 19, wherein said third aggregate includes borosilicate glass power.

25. A structure according to claim 19, wherein said third binder includes sodium silicates and said second binder includes silican sol.

26. A structure used in casting low-melting metals selected from the group consisting of aluminum, zinc and tin and their alloys, said structure comprising:

a substrate;

an adhesive coating layer in contact with the substrate and formed by an adhesive coating material having a melting point below 1000° C., said adhesive coating material including a first binder and a first aggregate, said first binder being selected from the group consisting of silicates, glass powder, phosphoric acid, phosphates, zirconium salt and aluminum cement, said first aggregate being selected from the group consisting of refractory oxides, non-oxide powders and metals powders, said adhesive coating layer having a thickness in the range of approximately 50 μm to 200 μm;

a corrosion-resistant outermost coating layer for contact with molten metal carried by said structure, said corrosion-resistant outermost layer being formed by a corrosion-resistant coating material containing approximately 5–80 wt. % of at least one fluorine compound having a melting point greater than 700° C. and the remainder of said corrosion-resistant outermost coating material including a second binder and a second aggregate, said second binder being selected from the group consisting of aluminum sol, silica sol, phosphates, silane compounds, metal alkoxides and metal acylates, said second aggregate being selected from the group consisting of non-oxide powders, refractory oxides and talc, said corrosion-resistant outermost coating layer having a thickness in the range of approximately 50 μm to 200 μm; and two intermediate layers positioned between said adhesive coating layer and said corrosion-resistant outermost coating layer, said two intermediate layers including an inner intermediate layer contacting said adhesive coating layer and an outer intermediate layer contacting said corrosion-resistant outermost coating layer;

said substrate, said adhesive coating layer, said inner and outer intermediate layers, and said corrosion-resistant outermost coating layer each having a coefficient of thermal expansion, said coefficient of thermal expansion of said inner intermediate layering being closer to the coefficient of thermal expansion of said adhesive coating layer than to the coefficient of thermal expansion of said corrosion-resistant outermost coating layer, said coefficient of thermal expansion of said outer intermediate layer being closer to the coefficient of thermal expansion of said corrosion-resistant outermost coating layer than to the coefficient of thermal expansion of said adhesive coating layer.

* * * * *